United States Patent [19]

Rusch

[11] 4,379,981

[45] Apr. 12, 1983

[54] FLUORESCENT LAMP HAVING IMPROVED BARRIER LAYER

[75] Inventor: Larry P. Rusch, East Brunswick, N.J.

[73] Assignee: Westinghouse Electric Corp., Pittsburgh, Pa.

[21] Appl. No.: 270,472

[22] Filed: Jun. 4, 1981

[51] Int. Cl.[3] ..... H01J 61/35; H01J 61/42; H01J 61/54

[52] U.S. Cl. ..... 313/489; 313/492

[58] Field of Search ..... 313/489, 493, 492

[56] References Cited

U.S. PATENT DOCUMENTS

| | | | |
|---|---|---|---|
| 3,624,444 | 11/1971 | Berthold et al. | 313/489 X |
| 3,963,954 | 6/1976 | Milke et al. | 313/489 |
| 3,967,153 | 6/1976 | Milke et al. | 313/489 |
| 4,020,385 | 4/1977 | Lagos | 313/489 |

*Primary Examiner*—Palmer C. Demeo

*Attorney, Agent, or Firm*—R. S. Lombard

[57] ABSTRACT

A cost-reduced fluorescent lamp having an electrically conductive first layer carried on the inner surface of a vitreous envelope and an electrically non-conductive second layer carried on the electrically conductive first layer. The electrically non-conductive second layer is a mixture of very finely-divided aluminum oxide and finely-divided titanium dioxide in predetermined relative weight ratio.

5 Claims, 1 Drawing Figure

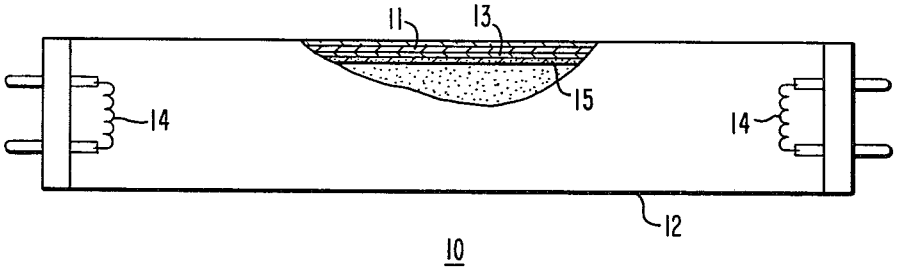
11
13
15
14
14
12
10

FLUORESCENT LAMP HAVING IMPROVED BARRIER LAYER

BACKGROUND OF THE INVENTION

This invention relates to fluorescent lamps, and, in particular, to a fluorescent lamp having an electrically non-conductive barrier layer over a transparent electrically conductive layer on the inner surface of the lamp envelope. The electrically conductive layer operates to lower the bulb wall surface resistance thereby reducing the voltage required for ignition of the fluorescent lamp. The electrically conductive layer typically comprises oxides of tin, antimony, cadmium, and indium, for example. However, such an electrically conductive layer that is unprotected from the lamp atmosphere tends to reduce lamp light output throughout the life of the lamp and discolors as the lamp ages. In addition, phosphor adherence problems may be encountered. It is known in the art that by providing a transparent non-electrically conductive barrier layer or film over the electrically conductive layer that these drawbacks are eliminated. In U.S. Pat. No. 3,967,153, dated June 29, 1976, issued to Milke et al., is disclosed such a fluorescent lamp having an electrically conductive coating and a protective coating therefor. The protective coating is a transparent layer or film of finely-divided powdered aluminum oxide coated on the electrically conductive coating and thin enough so as to be substantially transparent to the visible light emitted by the lamp. Another pertinent disclosure is set forth in Japanese Pat. No. 30,957/69 published Dec. 11, 1969.

SUMMARY OF THE INVENTION

The present invention is an improvement over the prior art in that the cost per lamp of the electrically non-conductive second layer is significantly reduced without a degradation in its effectiveness.

There is provided a fluorescent lamp comprising a vitreous envelope having electrodes operatively disposed at opposite ends thereof. An electrically conductive first layer is carried on the inner surface of the vitreous envelope. An electrically non-conductive second layer is carried on the electrically conductive layer. The electrically non-conductive second layer consists essentially of a mixture of very finely-divided aluminum oxide and finely-divided titanium dioxide in predetermined relative weight ratio. One or more layers of phosphor means is carried on the second layer.

BRIEF DESCRIPTION OF THE DRAWINGS

For a better understanding of the invention, reference may be had to the accompanying drawing in which the sole FIGURE is an elevational view, partly broken away, of a fluorescent lamp showing schematically the positions of the electrically conductive first layer and electrically non-conductive second layer and third layer of phosphor-containing material relative to each other.

DESCRIPTION OF THE PREFERRED EMBODIMENTS

Referring to the sole FIGURE there is provided a fluorescent lamp 10 comprising a vitreous envelope 12 having electrodes 14 operatively disposed at opposite ends thereof. A transparent electrically conductive first layer 11, typically comprised of, for example, tin oxide, antimony oxide, cadmium oxide or indium oxide, is carried on the inner surface of the vitreous envelope as is well known in the art. As stated previously, the conductive layer acts to lower the bulb wall surface resistance thus reducing the starting voltage requirement for the lamp. The electrically non-conductive second layer is carried on the electrically conductive first layer. The non-conductive second layer 13 or barrier layer consists essentially of a mixture of very finely-divided aluminum oxide and finely-divided titanium dioxide in predetermined relative weight ratio. It has been found that the predetermined relative weight ratio may be from about 10:1 to 2:1. The very finely divided aluminum oxide is preferably a sub-micron aluminum oxide sold under the trademark Aluminum Oxide-"C" by the Degussa Company, and the finely divided titanium dioxide is preferably of a type such as sold by the Degussa Company and designated Titanium Dioxide P-25. A third layer 15 of phosphor containing material is carried on the electrically non-conductive second layer as is well known in the art.

The electrically non-conductive layer of aluminum oxide-C such as disclosed in the aforesaid U.S. Pat. No. 3,967,153, issued to Milke et al. is typically on the order of 500 to 1000 nanometer in thickness to effect optimum benefit as a barrier layer. A layer such as this of 500 nm thickness would require more than 150 milligrams of aluminum oxide-C per 33–35 watt, 4 foot, lamp. Utilizing the electrically non-conductive second layer of the present invention, the material usage can be reduced to approximately 65 milligrams per 33–35 watt, 4 foot, lamp and the optimum benefits as a barrier layer are still realized. Furthermore, the cost of titanium dioxide P-25 is about 3% less than Aluminum Oxide-"C" so that the total material cost is reduced by more than 50%.

The following table compares the lamp data of a prior art lamp compared to the lamp of the present invention.

TABLE

| Lumens | | 0–100 hr | | | |
|---|---|---|---|---|---|
| 0 Hr. | 100 Hr. | Drop | % Maint. | Watts | Comments |
| 2888 | 2791 | 97 | 96.6% | 33.3 | 135 mg aluminum oxide-C second layer |
| 2878 | 2787 | 91 | 96.8% | 33.3 | 65 mg Aluminum Oxide-"C" + titanium dioxide P-25 second layer |

The electrically non-conductive second layer of the test lamps whose data appears in the above table was made and applied to the lamp in the following manner. An initial slurry of 3.0 weight percent $Al_2O_3$ and 0.5 weight percent $TiO_2$ is made in the following manner. A 25% slurry of $Al_2O_3$ is dispersed in water with high shear mixer such as a Cowles Dissolver and diluted to a final concentration of 6.0%. Alternatively a 6% slurry of $Al_2O_3$ can be dispersed in water directly with a low shear mixer such as a propeller mixer.

Secondly, a 20% slurry of $TiO_2$ is dispersed in water, containing approximately 2.0% (based on $TiO_2$) of a commercial dispersing agent such as Tamol 850 manufactured by Rohm and Haas Company, with a high shear mixer such as a Cowles Dissolver and diluted to a final concentration of 1%. Alternatively, a 3% slurry of $TiO_2$ in the water way be dispersed directly in a pebble mill and then diluted to 1% with water. Equal volume of the resulting 6% $Al_2O_3$ slurry and 1% $TiO_2$ slurry are admixed yielding an initial slurry of 3% $Al_2O_3$ and 0.5% $TiO_2$. To this initial slurry of 3.0% $Al_2O_3$ and 0.5%

$TiO_2$ (relative weight ratio 6:1) is added in the concentration of 15 cc's per 100 gallon of slurry, a commercial wetting agent such as sold by the General Aniline and Film Company under the trade designation IGEPAL CO-610, in the concentration of 10 cc's per 100 gallons of slurry; a commercial defoamer such as sold by the Witco Chemical Company under the trade designation Balab BB 748 and in the concentration of 2,000 cc's per 100 gallons of slurry; and a commercial film former which is a 2.5% solution of polyethylene oxide such as Polyox WSRN-750 sold by the Union Carbide Company, and water. The resulting slurry is then flush coated on washed envelopes and dried in warm air at about 180° F. in a drying chamber for about 3½ minutes. The completed electrically non-conductive second layer is approximately 250 nm in thickness.

The layer 15 comprising phosphor means is then applied over the formed second layer 13 by conventional techniques. As an alternative embodiment, more than one layer of phosphor can be utilized, and such multiple phosphor layers are now common practice in the art. Thus the phosphor means is formed in at least one layer.

I claim:

1. A fluorescent lamp comprising a vitreous envelope having electrodes operatively disposed at opposite ends thereof, an electrically conductive first layer carried on the inner surface of said vitreous envelope, an electrically non-conductive second layer carried on said electrically conductive first layer, said electrically non-conductive second layer consisting essentially of a mixture of very finely-divided aluminum oxide and finely-divided titanium dioxide in predetermined relative weight ratio, and phosphor means formed in at least one layer carried on said second layer.

2. The lamp of claim 1, wherein said electrically conductive first layer comprises tin oxide.

3. The lamp of claim 1, wherein said relative weight ratio between said very finely-divided aluminum oxide and said finely-divided titanium dioxide is from about 10:1 to 2:1.

4. The lamp of claim 3, wherein said relative weight ratio between said very finely-divided aluminum oxide and said finely-divided titanium dioxide is 6:1.

5. The lamp of claim 1, wherein said electrically non-conductive second layer is approximately 250 nanometer in thickness.

* * * * *